US011850717B2

(12) United States Patent
Ito et al.

(10) Patent No.: US 11,850,717 B2
(45) Date of Patent: Dec. 26, 2023

(54) FLUID PRESSURE STRIKING DEVICE

(71) Applicant: TEISAKU CORPORATION, Nagoya (JP)

(72) Inventors: Masanori Ito, Toyohashi (JP); Hiroshi Fujimoto, Toyohashi (JP)

(73) Assignee: TEISAKU CORPORATION, Nagoya (JP)

( * ) Notice: Subject to any disclaimer, the term of this patent is extended or adjusted under 35 U.S.C. 154(b) by 256 days.

(21) Appl. No.: 17/296,538

(22) PCT Filed: Nov. 7, 2019

(86) PCT No.: PCT/JP2019/043632

§ 371 (c)(1),
(2) Date: May 24, 2021

(87) PCT Pub. No.: WO2020/105447

PCT Pub. Date: May 28, 2020

(65) Prior Publication Data

US 2022/0024012 A1 Jan. 27, 2022

(30) Foreign Application Priority Data

Nov. 22, 2018 (JP) ..... 2018-219081

(51) Int. Cl.
*B25D 17/02* (2006.01)
*B25D 9/18* (2006.01)
*B25D 9/14* (2006.01)

(52) U.S. Cl.
CPC ..... *B25D 9/145* (2013.01); *B25D 9/18* (2013.01); *B25D 17/02* (2013.01); *B25D 2209/002* (2013.01)

(58) Field of Classification Search
CPC ..... B25D 9/145; B25D 9/18; B25D 17/02
See application file for complete search history.

(56) References Cited

U.S. PATENT DOCUMENTS 3,780,621 A 12/1973 Romell
4,401,030 A * 8/1983 Connolly ..... B44B 5/0085 101/316

(Continued)

FOREIGN PATENT DOCUMENTS

DE 4404009 C1 4/1995
JP S56 171184 U 12/1981

(Continued)

OTHER PUBLICATIONS

PCT ISR for PCT/JP2019/043632, dated Dec. 17, 2019, 3 pages.

(Continued)

*Primary Examiner* — Praachi M Pathak
(74) *Attorney, Agent, or Firm* — Patterson Thuente IP

(57) ABSTRACT

A fluid pressure hitting device comprises a piston inserted in a cylinder, a chisel, and a first, second, and third chambers. The chisel is fitted in the cylinder such that a part of the chisel projects from one axial end of the cylinder and is configured to further project from that axial end due to being hit by the piston as the piston slides toward the one axial end. The first through third chambers are partitioned by an inner peripheral surface of the cylinder and an outer peripheral surface of the piston. The first through third chambers are arranged in the axial direction in order fluid the one axial end to another axial end of the cylinder. A flow path is configured to supply fluid from a fluid supply portion when the piston hits the chisel, to the first chamber.

17 Claims, 7 Drawing Sheets

(56) References Cited

U.S. PATENT DOCUMENTS

| | | | | |
|---|---|---|---|---|
| 4,873,912 | A * | 10/1989 | Schulze | B30B 15/16 91/524 |
| 5,623,861 | A * | 4/1997 | Ward | F15B 15/225 251/117 |
| 2006/0278415 | A1 * | 12/2006 | Reis | B65D 88/66 173/13 |
| 2008/0021325 | A1 * | 1/2008 | Drost | A61B 8/4227 600/454 |
| 2008/0236297 | A1 | 10/2008 | Fleet et al. | |
| 2017/0065188 | A1 | 3/2017 | Jain et al. | |

FOREIGN PATENT DOCUMENTS

| | | | |
|---|---|---|---|
| JP | S63-93577 | A | 4/1988 |
| JP | H07-214479 | A | 8/1995 |
| JP | 2015-163425 | A | 9/2015 |
| JP | 2015-163426 | A | 9/2015 |
| JP | 2016-140929 | A | 8/2016 |
| JP | 2018-138321 | A | 9/2018 |
| WO | WO 2012/026571 | A1 | 3/2012 |

OTHER PUBLICATIONS

English translation of PCT ISR for PCT/JP2019/043632, dated Dec. 17, 2019, 2 pages.
Written Opinion for PCT/JP2019/043632, dated Dec. 17, 2019, 5 pages.
English translation of Written Opinion for PCT/JP2019/043632, dated Dec. 17, 2019, 6 pages.
Supplementary European Search Report from EP Application No. EP 19886108, dated Jul. 8, 2022, 7 pgs.
Extended European Search Report from application EP 19875237, dated Jun. 27, 2022, 10 pgs.

* cited by examiner

FLUID PRESSURE STRIKING DEVICE

CROSS-REFERENCE TO RELATED APPLICATIONS

The present application is a U.S. National Phase entry of, and claims priority to, PCT Application No. PCT/JP2019/043632, filed Nov. 7, 2019, which claims priority to Japanese Patent Application No. 2018-219081, filed Nov. 22, 2018, all of which are incorporated herein by reference in their entireties for all purposes.

FIELD OF THE INVENTION

The present disclosure relates to a fluid pressure hitting device.

BACKGROUND OF THE INVENTION

A fluid pressure hitting device can be used in the crushing work of concrete, rock, etc. A fluid pressure hitting device has a cylindrical cylinder, a piston fitted in the cylinder, and a rod-shaped chisel. The piston is slidable in the cylinder in an axial direction of the cylinder. The chisel may be fitted in the cylinder so that a part of the chisel projects from one axial end of the cylinder. As the piston slides in the axial direction in the cylinder toward the one axial end in the axial direction, the piston hits the chisel. As a result, the chisel projects further from the one end of the cylinder. This allows the tip of the chisel to be pressed against the part of concrete or rock to be crushed in order to crush it. The piston may be designed to slide in the cylinder toward one end side or the other end side in the axial direction using fluid pressure. There are various means for causing the piston to slide.

For example, Japanese Unexamined Patent Application Publication No. 2015-163426 discloses a piston front chamber (hereinafter referred to as a first chamber). The first chamber is formed by partitioning an inner peripheral surface of the cylinder and an outer peripheral surface of the piston. The first chamber is located near one end side (the chisel side) in the axial direction. The piston is configured to reciprocate in the axial direction of the cylinder by switching the pressure in the first chamber between a high liquid pressure and a low liquid pressure. For example, when the first chamber has a high liquid pressure, the piston is pushed out of the first chamber. This causes the piston to slide in the axial direction toward the other end side of the cylinder. When the first chamber has a low liquid pressure, the piston slides toward the one end in the axial direction.

In the mechanism of JP2015-163426, when the piston hits the chisel, the piston sharply moves in the axial direction toward the other end side of the cylinder as a result of the repulsive force of the hit. Thus, the piston sharply moves away from the first chamber. As a result, the volume of the first chamber sharply expands. This rapidly decreases the pressure in the first chamber. Further, when the piston hits the chisel, liquid is sharply pushed out of the first chamber. The liquid pushed out of the first chamber then returns into the first chamber from outside the first chamber. However, once the liquid sharply has been pushed out from the first chamber, the remaining liquid in the first chamber continues to flow out of the first chamber for a short time due to the outflowing force (inertial force). That is, the pressure in the first chamber may decrease further.

Due to the sharp decrease in pressure of the first chamber, the liquid in the first chamber can suddenly boil and/or vaporize. Additionally, any gas dissolved in the liquid may be released from the liquid. As a result, bubbles can be generated in the liquid. When the bubbles in the liquid burst, erosion of the fluid pressure hitting device may occur. When erosion occur, an inner wall of the first chamber, its surroundings, and a surface of the piston can be scraped off by the contraction force of the bubbles. The phenomenon associated with the generation and disappearance of bubbles is so-called cavitation. Cavitation and erosion can lower the durability of the first chamber and/or the piston. This can cause the failure of a liquid pressure hitting device, such as due to leakage of liquid from the first chamber.

Thus, an improved fluid pressure hitting device is required.

SUMMARY OF THE INVENTION

In the first aspect of the present disclosure, a fluid pressure hitting device comprises a cylindrical cylinder, a piston inserted in the cylinder, a bar-shaped chisel, a first chamber, a second chamber, and a third chamber. The piston is capable of sliding in an axial direction of the cylinder. The chisel is fitted in the cylinder such that a part of the chisel is projected from one axial end of the cylinder. The chisel is configured to be further projected from the one axial end of the cylinder by being hit by the piston when the piston slides to the one axial end side. The first chamber, the second chamber, and the third chamber are partitioned by an inner peripheral surface of the cylinder and an outer peripheral surface of the piston. The first chamber, the second chamber, and the third chamber are arranged in the axial direction in order from the one axial end to the other axial end of the cylinder. The piston is configured to slide to the one axial end or the other axial end in the cylinder when a fluid pressure in the first chamber is shifted to a high fluid pressure or a low fluid pressure. A flow path is formed in the fluid pressure hitting device. The flow path is configured to supply fluid from a fluid supply portion, which has a fluid pressure higher than that of the first chamber of when the piton hits the chisel, to the first chamber.

In this aspect, the flow path is formed in the fluid pressure hitting device. The flow path is configured to supply fluid from a fluid supply portion, which has a fluid pressure higher than that of the first chamber of when the piton hits the chisel, to the first chamber. Thus, even when the chisel is hit by the piston, fluid is supplied to the first chamber, thereby relaxing the low pressure state of the first chamber. Thus, the occurrence of cavitation in the first chamber can be suppressed. The "low pressure state" means a state in which fluid pressure become relatively lower as compared with a state immediately before.

In the second aspect of the present disclosure, the fluid supply portion may include the second chamber. In this aspect, since the second chamber is in the vicinity of the first chamber, fluid can be more quickly supplied to the first chamber. Thus, it becomes easier to relax the low pressure state of the first chamber of when the piston hits the chisel. In this way, the occurrence of cavitation can be further suppressed.

In the third aspect of the present disclosure, the fluid supply portion may include the third chamber. In this aspect, the third chamber has a high fluid pressure when the piston hits the chisel. Thus, a large amount of fluid can be supplied from the third chamber to the first chamber. Thus, the low pressure state of the first chamber can be more easily relaxed. In this way, the occurrence of cavitation can be further suppressed.

In the fourth aspect of the present disclosure, the flow path is provided with a check valve. The check valve is configured to allow for fluid flow from the fluid supply portion into the first chamber. The check valve is also configured to prevent fluid flow from the first chamber into the fluid supply portion. In this aspect, even when the pressure in the first chamber switches from the low fluid pressure to the high fluid pressure, fluid does not flow back from the first chamber to the fluid supply portion. That is, the high fluid pressure state of the first chamber is maintained. Thus, the low pressure state of the first chamber can be relaxed while efficiently operating the fluid pressure hitting device.

In the fifth aspect of the present disclosure, at least a part of the flow path is provided with a throttle portion where a fluid passage is narrowed. In this aspect, an appropriate amount of fluid may flow into the first chamber from the fluid supply portion, via the flow path having the throttle portion. Thus, the low pressure state of the first chamber can be relaxed within an appropriate range.

In the sixth aspect of the present disclosure, the fluid supply portion includes the second chamber and the third chamber. A flow path connecting the first chamber with the second chamber may be provided with a check valve. The check valve is configured to allow for fluid flow from the second chamber into the first chamber and to prevent fluid flow from the first chamber into the second chamber. At least a part of a flow path connecting the first chamber with the third chamber may be provided with a throttle portion where a fluid passage is narrowed.

In this aspect, even when fluid pressure in the first chamber switches from a low fluid pressure to a high fluid pressure, fluid does not flow back from the first chamber to the second chamber, which tends to have a lower fluid pressure as compared with the third chamber. That is, the high fluid pressure state of the first chamber is maintained. Thus, the low pressure state of the first chamber can be relaxed while efficiently operating the fluid pressure hitting device. On the other hand, it is possible to prevent an excessive amount of fluid flow from the third chamber, which tends to have a higher fluid pressure as compared with the second chamber, to the first chamber. Thus, the low pressure state of the first chamber can be relaxed while reducing influence on the function of the third chamber.

In the seventh aspect of the present disclosure, a fourth chamber may be provided between the second chamber and the third chamber. The fourth chamber is partitioned by the inner peripheral surface of the cylinder and the outer peripheral surface of the piston. The fluid supply portion may include the fourth chamber. Fluid can be supplied from the fourth chamber to the first chamber when the piston hits the chisel.

In this aspect, fluid can be supplied from the fourth chamber to the first chamber when the piston hits the chisel. Thus, the fluid can be supplied to the first chamber at an appropriate timing. In this way, the low pressure state of the first chamber can be more accurately relaxed. Additionally, the occurrence of cavitation can be more accurately suppressed.

In the eighth aspect of the present disclosure, the third chamber may always be in a high fluid pressure state. In this aspect, since the third chamber is always in a high fluid pressure state, the hitting force applied to the chisel by the piston can be increased. Thus, the piston may receive a stronger repulsive force from the chisel, thereby sliding to the other axial end side of the cylinder to a greater extend. Accordingly, the first chamber tends to enter into a lower pressure state. Thus, when the third chamber is always in a high fluid pressure state, the frequency of cavitation is higher. However, according to the above configuration, the flow path is formed so as to supply fluid from the fluid supply portion to the first chamber. This allows for relaxing the low pressure state of the first chamber when the piston hits the chisel. Further, it is possible to suppress the frequency of cavitation, peculiar to the case where the third chamber is always in a high fluid pressure state.

DETAILED DESCRIPTION OF THE DRAWINGS

Hereinafter, a fluid pressure hitting device, and its operation, according to various embodiment will be described with reference to FIGS. 1 to 5. In the following, the upward direction is referred to as "upward" and the downward direction is referred to as "downward" on the basis of the corresponding states, which are shown in FIGS. 1 to 5. The directions correspond to those of a fluid pressure hitting device that is actually being used in the work of crushing concrete, rock, etc.

Figure 1:
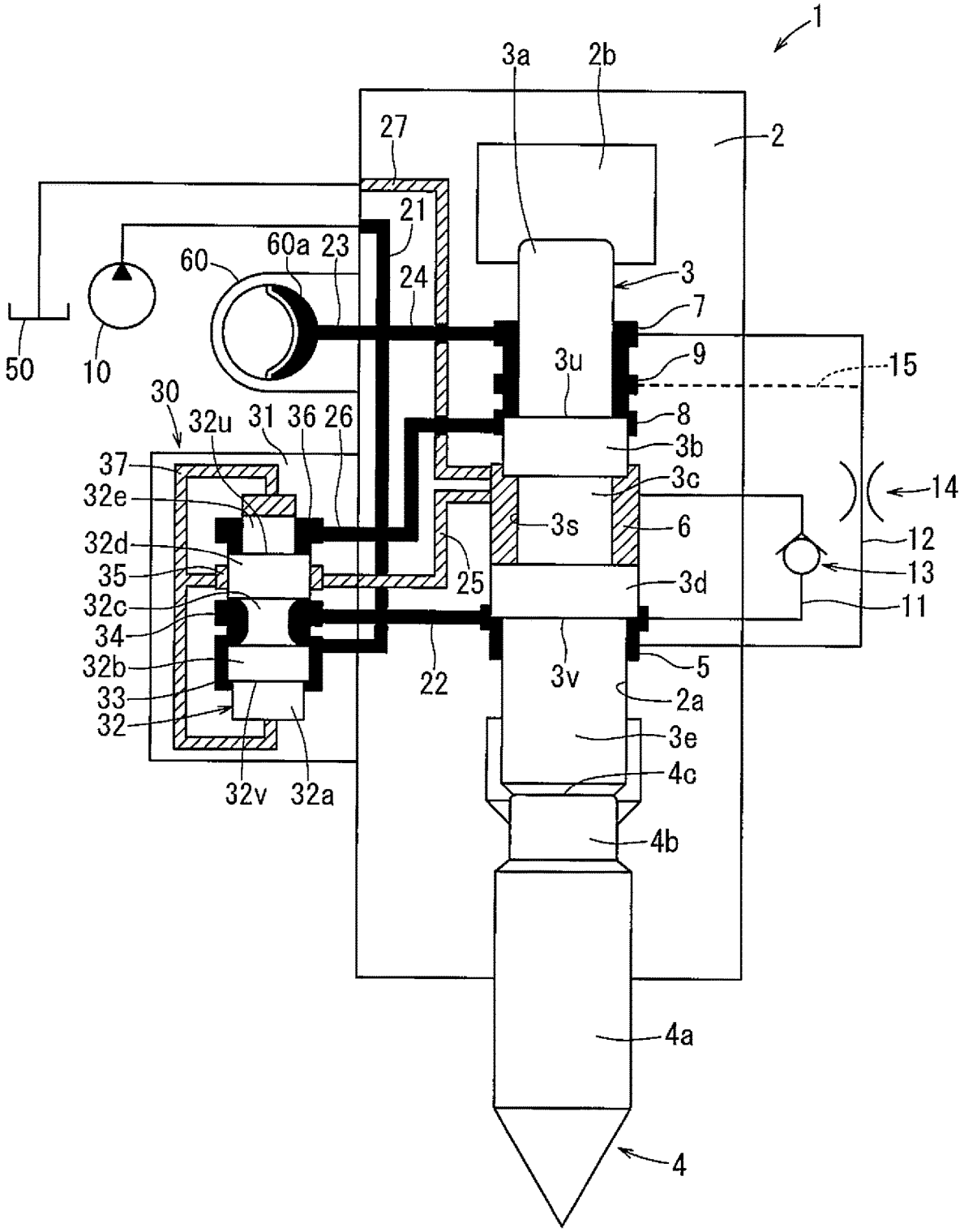
FIG. 1 is a schematic view of a fluid pressure hitting device.

The fluid pressure hitting device 1 shown in FIG. 1 may be a hydraulic type using oil as a fluid. The fluid pressure hitting device 1 shown in FIG. 1 is an example of an embodiment according to the present disclosure. The fluid pressure hitting device 1 has a cylinder 2, a piston 3, and a chisel 4. The cylinder 2 is a tubular member having an inner peripheral surface 2*a*. The piston 3 is inserted in the cylinder 2 so that the piston 3 fits in the inner peripheral surface 2*a*. A gas chamber 2*b* is formed on a rear end side (upper side in FIG. 1) of the piston 3. The gas chamber 2*b* is configured to enclose a gas, such as nitrogen, to assist the piston 3 at the time of hitting.

As shown in FIG. 1, the piston 3 has a first small diameter portion 3*a*, a first large diameter portion 3*b*, an intermediate portion 3*c*, a second large diameter portion 3*d*, and a second small diameter portion 3*e*, all of which are columnar in shape and are arranged in this order from the upper side to the lower side of the piston. The first large diameter portion 3*b* has a ring-shaped surface on its upper side. This ring-shaped surface is formed as a piston upper-side pressure receiving surface 3*u*. The second large diameter portion 3*d* has a ring-shaped surface on its lower side. The ring-shaped surface of the second large diameter portion 3*d* is formed as a piston lower-side pressure receiving surface 3*v*. The area of the piston upper-side pressure receiving surface 3*u* may be smaller than that of the piston lower-side pressure receiving surface 3*v*.

As shown in FIG. 1, the inner peripheral surface 2*a* of the cylinder 2 is provided with a first chamber 5, a second chamber 6, a pilot chamber 8, and a third chamber 7, which are arranged in the axial direction in this order from one axial end side (lower side in FIG. 1) to the other axial end side (upper side in FIG. 1) of the cylinder 2. Each chamber is formed as a ring-shaped groove. The first chamber 5, the second chamber 6, the pilot chamber 8, and the third chamber 7 are generally formed by being partitioned from each other by the inner peripheral surface 2*a* of the cylinder 2 and the outer peripheral surface 3*s* of the piston 3. Each of the first chamber 5, the second chamber 6, the pilot chamber 8, and the third chamber 7 may be arranged such that the third chamber 7 and the pilot chamber 8 are in communication with or disconnected from each other depending on the position of the piston 3, as will be described later. This communication/disconnection may occur during the reciprocating motion of the piston 3 in the axial direction (vertical direction in FIG. 1). Further, each of the first chamber 5, the second chamber 6, the pilot chamber 8, and the third chamber 7 may be arranged such that the second chamber 6 and the pilot chamber 8 are in communication with or disconnected from each other depending on the position of the piston 3 during the reciprocating motion of the piston 3 in the axial direction.

As shown in FIG. 1, the chisel 4 is a pile-shaped member. The chisel 4 has a tip portion 4*a* and a rear end portion 4*b*. The tip portion 4*a* is configured to pierce. The rear end portion 4*b* has a rear end surface 4*c* having a flat shape. The rear end surface 4*c* is provided on an upper end of the chisel 4. The chisel 4 may be inserted through an opening located at one axial end (lower end) of the cylinder 2. The tip portion 4*a*, which is a part of the chisel 4, may be installed so as to project from the one axial end of the cylinder 2. When the piston 3 hits the rear end surface 4*c* of the chisel 4, the chisel 4 may project further from the one axial end of the cylinder 2.

As shown in FIG. 1, the first chamber 5 and the second chamber 6 are in communication with each other via a first flow path 11 (flow path). A check valve 13 is provided in the middle of the first flow path. Although the check valve 13 allows oil to flow into the first chamber 5 from the second chamber 6, the check valve 13 prevents oil from flowing into the second chamber 6 from the first chamber 5.

As shown in FIG. 1, the first chamber 5 and the third chamber 7 are in communication with each other via a second flow path 12 (flow path). A part of or the entire second flow path 12 has a throttle portion 14. In the throttle portion 14, a passage for oil is narrowed. The throttle portion 14 does not allow for an excessive flow of oil.

As shown in FIG. 1, the fluid pressure hitting device 1 further includes a hydraulic pump 10, a switching valve 30, an oil tank 50, and an accumulator 60. The hydraulic pump 10 is always in communication with the third chamber 7 formed in the cylinder 2, via a passage 24 branching from a passage 21. When the fluid pressure hitting device 1 is in operation, the hydraulic pump 10 continues to supply fluid to the third chamber 7 through the passage 24. Thus, the third chamber 7 can be kept in a high fluid pressure state.

As shown in FIG. 1, the switching valve 30 is configured to switch the stroke direction of the piston 3. The switching valve 30 has a switching valve cylinder 31 and a valve 32. The switching valve cylinder 31 is tubular. An upper end opening and a lower end opening of the switching cylinder 31 are in communication with each other by a communication passage 37.

As shown in FIG. 1, the valve 32 is fitted in the switching valve cylinder 31 so that the valve 32 can slide in the axial direction (i.e. vertical direction in FIG. 1). The valve 32 has a cylindrical valve first small diameter portion 32*a*, a valve first large diameter portion 32*b*, a connection portion 32*c*, a valve second large diameter portion 32*d*, and a valve second small diameter portion 32*e*, all of which are arranged in this order from the bottom to the top of the valve 32. The valve first large diameter portion 32*b* has a ring-shaped lower surface. This lower surface is set as a valve lower-side pressure receiving surface 32*v*. The valve second large diameter portion 32*d* has a ring-shaped upper surface. This upper surface is set as a valve upper-side pressure receiving surface 32*u*. The area of the valve lower-side pressure receiving surface 32*v* may be set smaller than that of the valve upper-side pressure receiving surface 32*u*.

As shown in FIG. 1, an inner surface of the switching valve cylinder 31 is provided with a valve high pressure chamber 33, a valve reversing chamber 34, a valve low pressure chamber 35, and a valve pilot chamber 36, all of which are arranged in this order from the bottom to the top. Each chamber 33-36 is formed as a ring-shaped groove. The arrangement of the valve high pressure chamber 33, the valve reversing chamber 34, the valve low pressure chamber 35, and the valve pilot chamber 36 may be such that the valve high pressure chamber 33 and the valve reversing chamber 34 are in communication with or disconnected from each other depending on the position of the valve 32 reciprocating in the vertical direction. Also, the arrangement of the valve high pressure chamber 33, the valve reversing chamber 34, the valve low pressure chamber 35, and the valve pilot chamber 36 may be such that the valve low pressure chamber 35 and the valve reversing chamber 34 are in communication with or disconnected from each other depending on the position of the valve 32 reciprocating in the vertical direction.

As shown in FIG. 1, the valve high pressure chamber 33 is always in communication with the hydraulic pump 10 via the passage 21. When the fluid pressure hitting device 1 is operated, the hydraulic pump 10 continues to supply oil to the valve high pressure chamber 33 through the passage 21. Thus, the valve high pressure chamber 33 can be kept in a high fluid pressure state. The valve reversing chamber 34 is in communication with the first chamber 5 via a passage 22. The valve low pressure chamber 35 is in communication with the second chamber 6 via a passage 25. The valve pilot chamber 36 is in communication with the pilot chamber 8 via a passage 26.

As shown in FIG. 1, the oil tank 50 is in communication with the second chamber 6 through a passage 27, which communicates with the oil tank 50 where the discharged oil is received.

As shown in FIG. 1, the accumulator 60 is provided with a chamber 60*a* having a contractile force inside. The accumulator 60 is configured to maintain the fluid pressure in the passages 21, 23, 24 in communication with the accumulator 60, so that the fluid pressure in the passages 21, 23, 24 is prevented form decreasing too much. Further, the accumulator 60 is configured to maintain the fluid pressure in the third chamber 7 and the valve high pressure chamber 33, which are in communication with the accumulator 60 via the passages 21, 23, 24, so that the fluid pressure in the third chamber 7 and the valve high pressure chamber 33 does not decrease too much. For example, when the fluid pressure drops, the accumulator 60 discharges oil, which was previously taken into the chamber 60*a*, from the chamber by the contractile force of the accumulator 60. In this way, the accumulator 60 can suppress a decrease in the fluid pressure of the passages 21, 23, 24, the third chamber 7, and the valve high pressure chamber 33.

Figure 2:
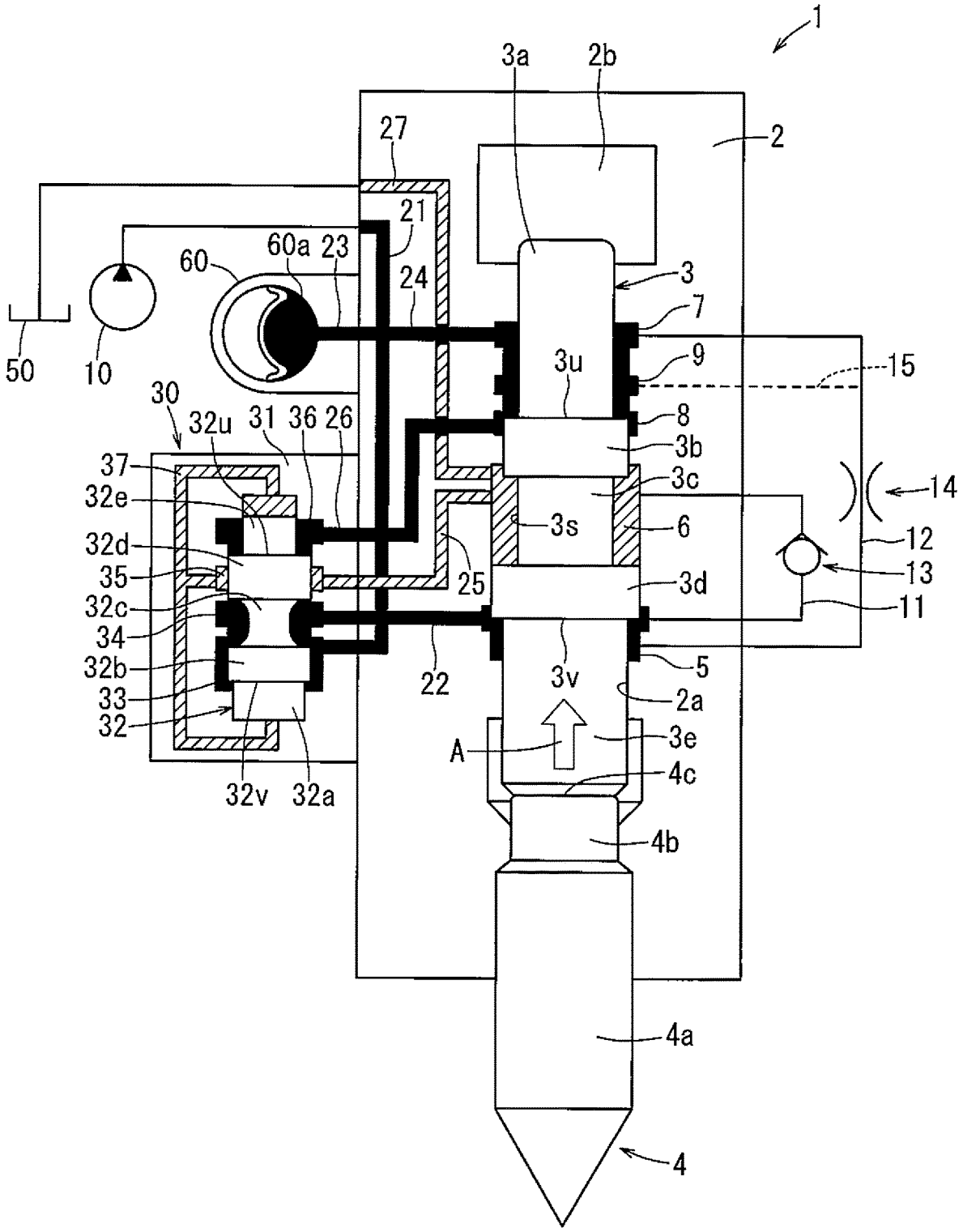
FIG. 2 is a schematic view of the fluid pressure hitting device when a piston is being raised.

The operation of the fluid pressure hitting device 1 will be described with reference to FIGS. 2 to 5. FIG. 2 shows a state immediately after the piston 3 hits the rear end surface 4*c* of the chisel 4. At this time, the tip portion 4*a* of the chisel 4 is in a state of being pressed against a portion of concrete or rock to be crushed. In this state as shown in FIG. 2, the hydraulic pump 10 continues to supply oil to the third chamber 7, via the passage 21 and the passage 24 branching from such passage 21. Further, the hydraulic pump 10 continues to supply oil to the valve high pressure chamber 33 via the passage 21. Thus, the third chamber 7 and the valve high pressure chamber 33 are in a high fluid pressure state.

When the piston 3 is positioned as shown in FIG. 2, the pilot chamber 8 is in communication with the third chamber 7. When the valve 32 is positioned as shown in FIG. 2, the valve reversing chamber 34 is in communication with the valve high pressure chamber 33. Thus, the pilot chamber 8 and the valve reversing chamber 34 are in a high fluid pressure state. Further, the pilot chamber 8 is in communication with the valve pilot chamber 36 via the passage 26. The valve reversing chamber 34 is in communication with the first chamber 5 via the passage 22. Thus, the valve pilot chamber 36 and the first chamber 5 are also in a high fluid pressure state.

As described above, both the first chamber 5 and the third chamber 7 shown in FIG. 2 are in a high fluid pressure state. Thus, the same fluid pressure is applied, per unit area, to the piston upper-side pressure receiving surface 3*u* as it is to the piston lower-side pressure receiving surface 3*v*. The area of the piston lower-side pressure receiving surface 3*v* is larger than that of the piston upper-side pressure receiving surface 3*u*. Thus, when the fluid pressure applied per unit area is the same, the piston 3 is moved in the axial direction toward the other end side of the cylinder 2 (upper side in FIG. 2), as shown by the arrow A in FIG. 2.

Figure 3:
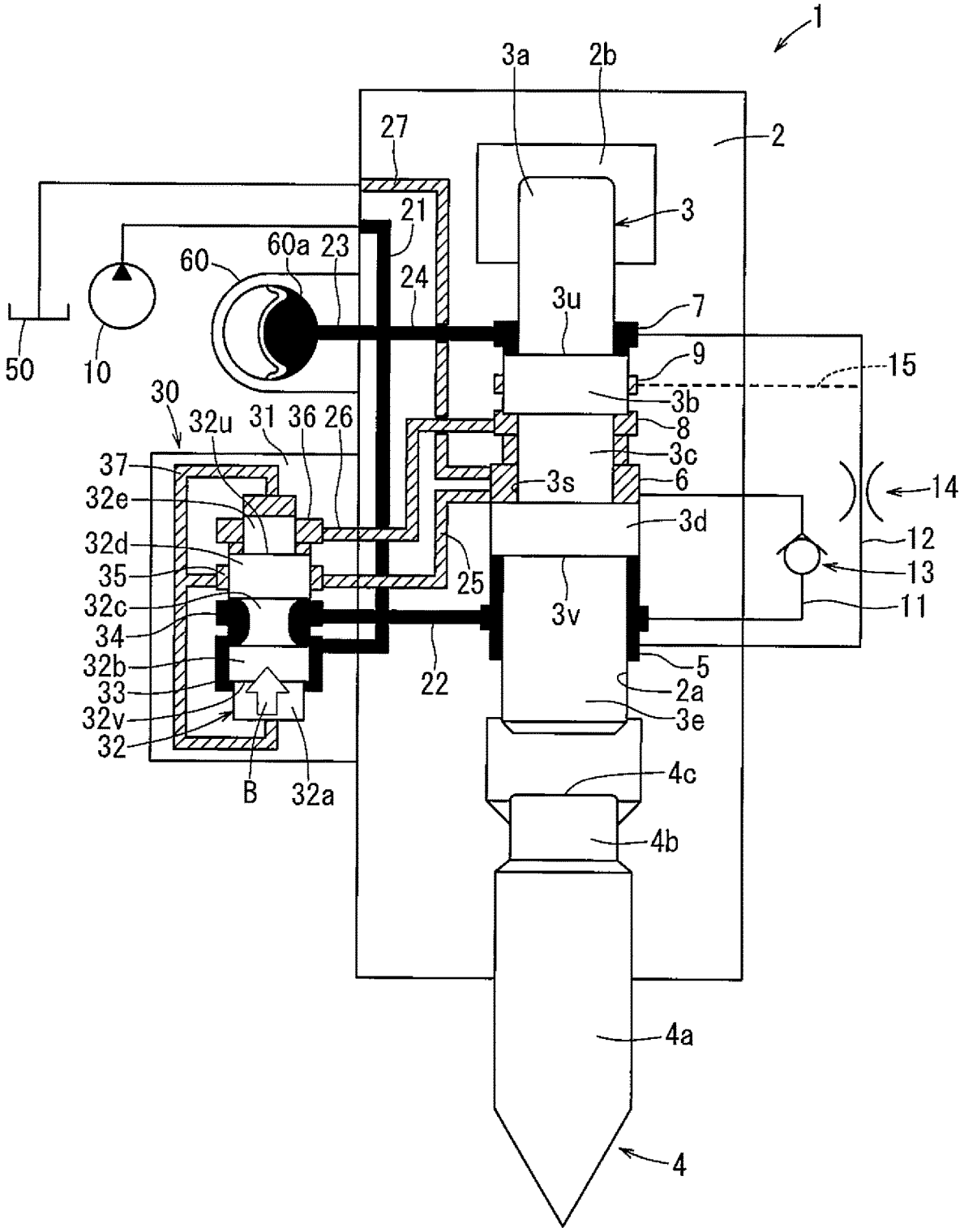
FIG. 3 is a schematic view of the fluid pressure hitting device when a valve is being raised.

FIG. 3 shows a state in which the piston 3 has moved toward the other axial end side of the cylinder 2 in order to reach its top dead center. As shown in FIG. 3, the first large diameter portion 3*b* blocks a space between the third chamber 7 and the pilot chamber 8. This causes the third chamber 7 to become disconnected from the pilot chamber 8. Further, the first large diameter portion 3*b* moves away from the area between the second chamber 6 and the pilot chamber 8. This causes the second chamber 6 to be in communication with the pilot chamber 8. As a result, oil is prevented from flowing into the pilot chamber 8. The second chamber 6 is in communication with the oil tank 50 via the passage 27. Thus, the pilot chamber 8, which is in communication with the second chamber 6, is placed in a low fluid pressure state. The pilot chamber 8 is in communication with the valve pilot chamber 36 via the passage 26. Thus, the valve pilot chamber 36 also is placed in a low fluid pressure state.

As described above, the valve pilot chamber 36 shown in FIG. 3 enters the low fluid pressure state. As shown in FIG. 3, the valve high pressure chamber 33 is in communication with the hydraulic pump 10 via the passage 21. Thus, the valve high pressure chamber 33 is kept in a high fluid pressure state. Since the valve high pressure chamber 33 is in a high fluid pressure state, the high fluid pressure presses against the valve lower-side pressure receiving surface 32*v*. As a result, the valve 32 is moved in the direction of arrow B, i.e. toward the upper side in FIG. 3.

Figure 4:
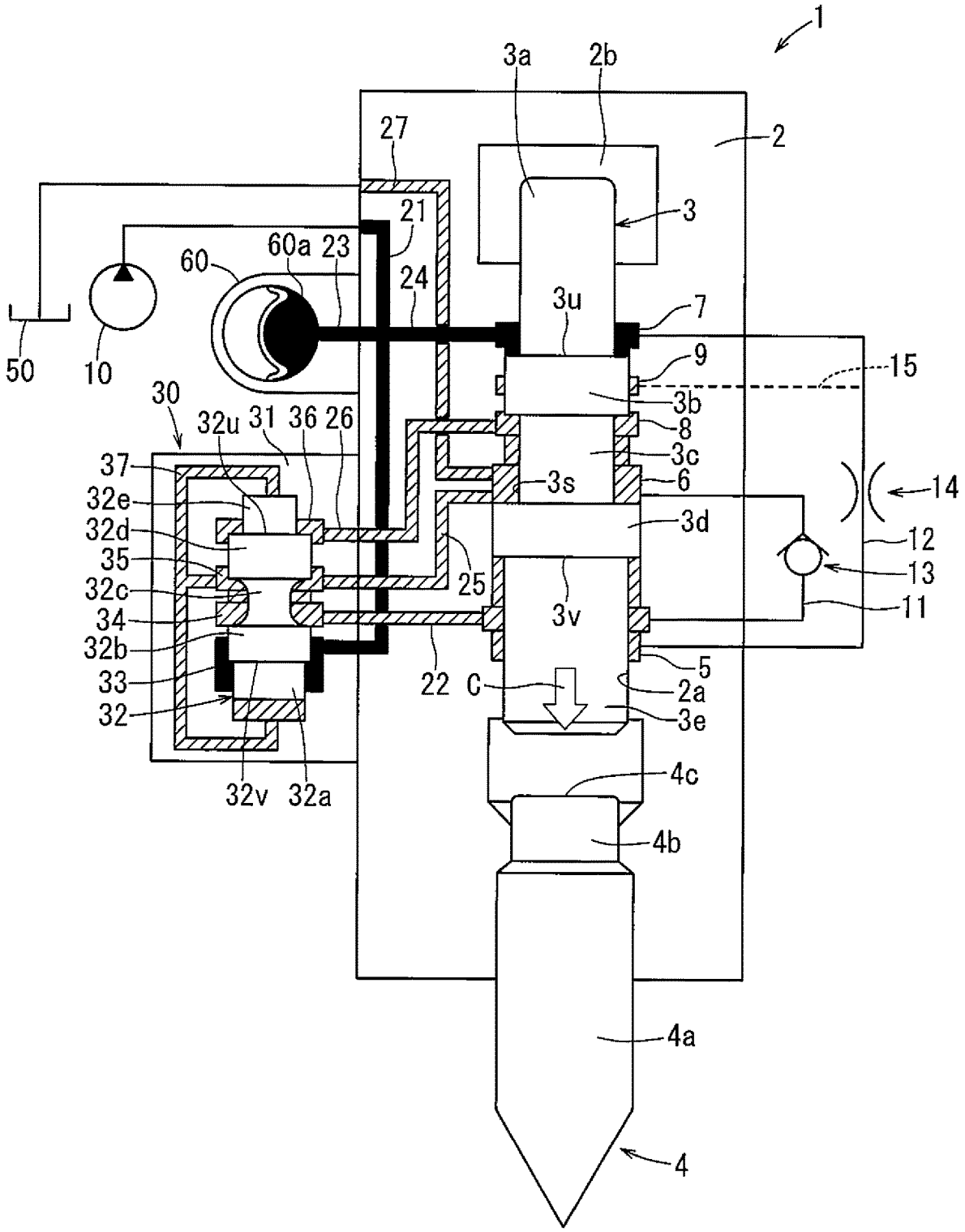
FIG. 4 is a schematic view of the fluid pressure hitting device when the piston is being lowered.

FIG. 4 shows a state in which the valve 32 has moved upward in order to reach its top dead center. As shown in FIG. 4, the valve first large diameter portion 32*b* blocks a space between the valve high pressure chamber 33 and the valve reversing chamber 34. As a result, the valve high pressure chamber 33 is disconnected from the valve reversing chamber 34. Further, the valve second large diameter portion 32*d* moves away from between the valve reversing chamber 34 and the valve low pressure chamber 35. As a result, the valve reversing chamber 34 becomes in communication with the valve low pressure chamber 35. The valve low pressure chamber 35 remains in communication with the second chamber 6 via the passage 25. The second chamber 6 is in communication with the oil tank 50 via the passage 27. Thus, the valve reversing chamber 34, which is now in communication with the valve low pressure chamber 35, enters a low fluid pressure state. Since, the first chamber 5 is in communication with the valve reversing chamber 34 via the passage 22, the first chamber 5 also enters a low fluid pressure state. Since the third chamber 7 is still in communication with the hydraulic pump 10 via the passages 21, 24, the third chamber 7 is kept in a high fluid pressure state. Thus, the high fluid pressure in the third chamber 7 presses the upper-side pressure receiving surface 3*u*, which causes the piston 3 to be moved in the direction of arrow C, i.e. toward one axial end side (lower side in FIG. 4).

Figure 5:
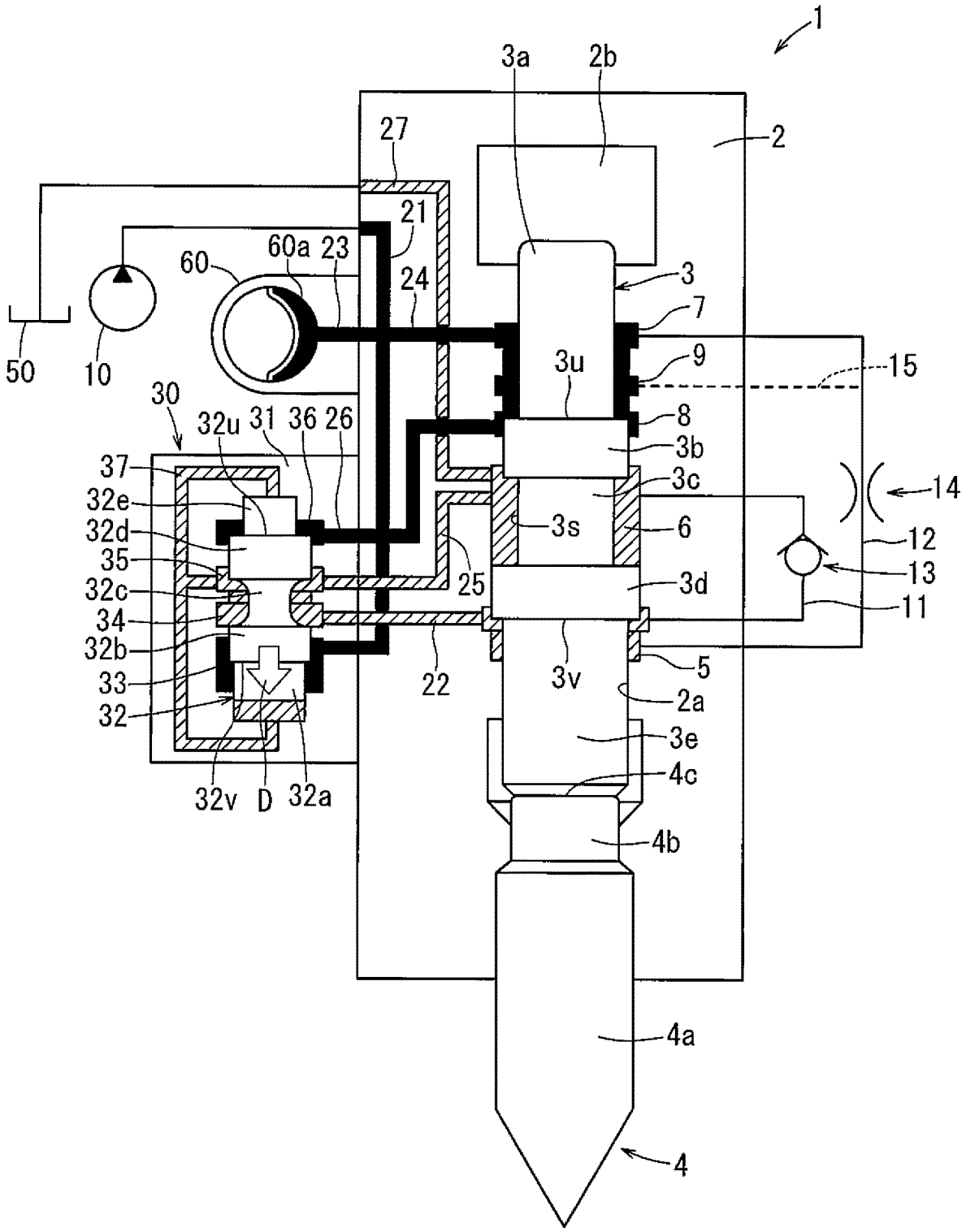
FIG. 5 is a schematic view of the fluid pressure hitting device when the valve is being lowered.

FIG. 5 shows a moment when the piston 3 hits the rear end surface 4*c* of the chisel 4. The piston 3 hits the rear end surface 4*c* of the chisel 4 after the piston 3 has moved in the axial direction toward the one end side. As shown in FIG. 5, the first large diameter portion 3*b* blocks the space between the second chamber 6 and the pilot chamber 8. This causes the second chamber 6 to be disconnected from the pilot chamber 8. As the piston 3 moves toward the one end side, the first large diameter portion 3*b* of the piston 3 moves away from the space between the third chamber 7 and the pilot chamber 8. As a result, the third chamber 7 becomes in communication with the pilot chamber 8. The third chamber 7 also remains in communication with the hydraulic pump 10 via the passages 21, 24. Thus, both the third chamber 7 and the pilot chamber 8 enter a high fluid pressure state. Further, the pilot chamber 8 is in communication with the valve pilot chamber 36 via the passage 26. Thus, the valve pilot chamber 36 also enters a high fluid pressure state. Further, the valve high pressure chamber 33 is in communication with the hydraulic pump 10 via the passage 21. Thus, the valve high pressure chamber 33 also enters a high fluid pressure state.

The volume of the third chamber 7 can be enlarged when the piston 3 moves toward the one end side. This allows additional oil to flow into the expanded region of the third chamber 7. As a result, the fluid pressure of the passages 21, 23, 24 and the third chamber 7 can temporarily decrease. In the state shown in FIG. 5, the previously accumulated oil in the chamber 60*a* of the accumulator 60, which can be seen in the state depicted in FIG. 3, can be discharged by the contraction force of the chamber 60*a*. In this way, a drop in the fluid pressure of the passages 21, 23, 24 and the third chamber 7 can be suppressed.

As described above, the valve high pressure chamber 33 and the valve pilot chamber 36 are in a high fluid pressure state during the stage shown in FIG. 5. The area of the valve lower-side pressure receiving surface 32*v* is smaller than that of the valve upper-side pressure receiving surface 32*u*. Thus, since the fluid pressure applied per unit area is the same on both of these surfaces 32*u*, 32*v*, the valve 32 moves in the direction of arrow D, i.e. toward the lower side in FIG. 5. When the valve 32 is moved in the direction of the arrow D, the valve second large diameter portion 32*d* blocks a space between the valve low pressure chamber 35 and the valve reversing chamber 34, as shown in FIG. 2. As a result, the valve low pressure chamber 35 becomes disconnected from the valve reversing chamber 34. Further, the valve large diameter portion 32*b* is moved away from the area between the valve high pressure chamber 33 and the valve reversing chamber 34. As a result, the valve high pressure chamber 33 becomes in communication with the valve reversing chamber 34. The valve high pressure chamber 33 is in communication with the hydraulic pump 10 via the passage 21. Thus, the valve reversing chamber 34, which is now in communication with the valve high pressure chamber 33, also enters a high fluid pressure state. Since the first chamber 5 is in communication with the valve reversing chamber 34 via the passage 22, the first chamber 5 also enters a high fluid pressure state.

As described the above, while the oil is continuously supplied from the hydraulic pump 10, the fluid pressure hitting device 1 is configured to repeat operations of FIGS. 2 to 5. As a result, the piston 3 reciprocates in the axial direction of the cylinder 2 so as to repeatedly hit the chisel 4. In this way, the tip portion 4*a* of the chisel 4 can be repeatedly pressed against a portion to be crushed, so as to crush that portion.

As shown in FIG. 5, when the piston 3 hits the rear end surface 4*c* of the chisel 4, the piston 3 is rapidly moved (e.g., ricochets) in the axial direction toward the other end side (upper side in FIG. 5) of the cylinder 2 due to the repulsive force of the hit. Thus, the piston 3 (in particular the second large diameter portion 3*d* of the piston 3) is rapidly moved away from the first chamber 5. Accordingly, the volume of the first chamber 5 rapidly expands. This rapidly reduces the pressure in the first chamber 5. Further, when the piston 3 hits the chisel, oil is rapidly pushed out of the first chamber 5, such as into the passage 22. After that, the oil, which had been pushed out of the first chamber 5, again flows into the first chamber 5. However, once the oil begins to be rapidly pushed out of the first chamber 5, the oil continues to flow out of the first chamber 5 for a short period of time due to its momentum or inertial force. That is, normally, the pressure in the first chamber 5 can be further reduced. Due to such a rapid decrease in the pressure of the first chamber 5, the oil in the first chamber 5 can suddenly boil and/or vaporize. Further, gas dissolved in the liquid can be released from the liquid, such that bubbles may be generated in the oil. Thus, there is a concern about cavitation and/or erosion.

As shown in FIG. 1, the fluid pressure hitting device 1 has a first flow path 11 that connects the first chamber 5 with the second chamber 6. When the piston 3 hits the chisel 4, the pressure in the first chamber 5 becomes lower than that of the second chamber 6. This may cause the oil to flow from the second chamber 6 to the first chamber 5 via the first flow path 11. This flow can relax the low pressure state of the first chamber 5. Since, the second chamber 6 is positioned adjacent to the first chamber 5, oil can be quickly supplied to the first chamber 5 from the second chamber 6. Thus, the low pressure state of the first chamber 5, which may be caused when the piston 3 hits the chisel 4, can be easily relaxed. In this way, the occurrence of cavitation can be further suppressed.

Further, as shown in FIG. 1, a check valve 13 is provided in the middle of the first flow path 11. Although the check valve 13 allows oil to flow from the second chamber 6 to the first chamber 5, the check valve 13 prevents oil from flowing from the first chamber 5 into the second chamber 6. Thus, even when the first chamber 5 is switched from a low fluid pressure state to a high fluid pressure state, the fluid does not flow from the first chamber 5 back into the second chamber 6. That is, since a high fluid pressure state of the first chamber 5 may be maintained, the low pressure state of the first chamber 5 can be relaxed while efficiently operating the fluid pressure hitting device 1.

Further, as shown in FIG. 1, the fluid pressure hitting device 1 has the second flow path 12 that connects the first chamber 5 with the third chamber 7. When the piston 3 hits the chisel, the pressure in the first chamber 5 is lower than that of the third chamber 7. Thus, oil may flow from the third chamber 7 to the first chamber 5, via the second flow path 12. The third chamber 7 has a high fluid pressure when the piston 3 hits the chisel 4. Thus, a large amount of oil can be supplied to the first chamber 5 from the third chamber 7. Thus, the low pressure state of the first chamber 5 can be easily relaxed. Additionally, the occurrence of cavitation can be further suppressed.

Further, as shown in FIG. 1, a part of the second flow path 12 or the entire second flow path 12 has a throttle portion 14. In the throttle portion 14, the passage for oil is narrowed. The throttle portion 14 does not allow for an excessive flow of oil. Thus, when a throttle portion 14 is provided, an appropriate amount of oil can flow from the third chamber 7 to the first chamber 5 through the second flow path 12. Thus, the low pressure state of the first chamber 5 can be relaxed within an appropriate range, without excessively decreasing the fluid pressure in the third chamber 7.

Further, in the fluid pressure hitting device 1, the third chamber 7 is always in communication with the hydraulic pump 10. Thus, the third chamber 7 is always in a high fluid pressure state. Since the third chamber 7 is always in the high fluid pressure state, the hitting force of the chisel 4, which is supplied from the piston 3, can be strong. Thus, the piston 3 may receive a stronger repulsive force from the chisel 4, such that the piston 3 slides toward the other axial end side of the cylinder 2. In this way, the first chamber 5 can easily enter a lower pressure state. Typically, when the third chamber 7 is always in a high fluid pressure state, the frequency of cavitation usually increases. However, in the fluid pressure hitting device 1, the first flow path 11 and the second flow path 12 are formed to supply oil from the second and third chambers 6, 7 to the first chamber 5. As a result, the low pressure state of the first chamber 5 can be relaxed. Thus, the frequency of cavitation, which often occurs in the case where the third chamber 7 is constantly in a high fluid pressure state, can be suppressed.

The present disclosure is not limited to the embodiments discussed above, which were described with reference to FIGS. 1 to 5. Various changes, additions, and deletions can be made without changing the gist of the present disclosure. For example, as shown in FIG. 1, a fourth chamber 9 may be provided between the second chamber 6 and the third chamber 7. The fourth chamber 9 may be formed as a ring-shaped groove provided on the inner peripheral surface 2*a* of the cylinder 2. The fourth chamber 9 may be partitioned by the inner peripheral surface 2*a* of the cylinder 2 and the outer peripheral surface 3*s* of the piston 3. As shown by the broken line in FIG. 1, a third flow path (flow path) 15, which connects the fourth chamber 9 with the first chamber 5, may be provided. The third flow path 15 may be provided together with the second flow path 12, which connects the third chamber 7 with the first chamber 5, or instead of the second flow path 12. That is, a fluid supply portion may include a fourth chamber 9 in addition to the third chamber 7. Alternatively, the fluid supply portion may include a fourth chamber 9 instead of a third chamber 7.

As shown in FIG. 4, when the piston 3 is at its top dead center, the first large diameter portion 3*b* of the piston 3 blocks the area between the third chamber 7 and the fourth chamber 9. Thus, the third chamber 7 is disconnected from the fourth chamber 9. When the piston 3 moves to the one axial end side (lower side in the Figures) of the cylinder 2, in a process of going from FIG. 4 to FIG. 5, the first large diameter portion 3*b* of the piston 3 also moves to the one axial end side of the cylinder 2. At this time, the first large diameter portion 3*b* does not block communication between the third chamber 7 and the fourth chamber 9. Thus, the third chamber 7 and the fourth chamber 9 may be in communication with each other. Since the third chamber 7 remains in communication with the hydraulic pump 10 via the passages 21, 24, the third chamber 7 is in a high fluid pressure state. Thus, the fourth chamber 9, which is in communication with the third chamber 7, also enters a high fluid pressure state.

Thus, when the piston 3 hits the chisel 4, oil is supplied to the first chamber 5 from the fourth chamber 9 via the third flow path 15. In this way, oil can be supplied to the first chamber 5 at an appropriate timing. That is, the low pressure state of the first chamber 5 can be relaxed more accurately so as to suppress the occurrence of cavitation. It is noted that "when the piston 3 hits the chisel 4" means "immediately before the piston 3 hits the chisel 4, at the same time as the hitting, and/or immediately after the hitting." In order to relax the low pressure state of the first chamber 5 at an appropriate timing, it is desirable that the oil may be supplied to the first chamber 5 immediately before the piston 3 hits the chisel 4 or at the same time.

When the fluid supply portion has a third chamber 7 and a second flow path 12, oil is continuously supplied from the third chamber 7 to the first chamber 5 as the piston 3 moves downward. For example, only a third flow path 15 may be provided, instead of also including a second flow path 12. Further, only a fourth chamber 9 may be included in the fluid supply portion, instead of also including a third chamber 7. In this case, as shown in FIGS. 4 and 5, only when the piston 3 hits the chisel 4, the oil is allowed to flow from the fourth chamber 9 into the first chamber 5 through the third flow path 15. Thus, it is possible to prevent oil from wastefully flowing out from the third chamber 7. That is, the occurrence of cavitation in the first chamber 5 can be more easily suppressed, while maintaining operating efficiencies the fluid pressure hitting device.

As mentioned above, the fluid pressure hitting device 1 is, for example, a hydraulic type using oil as a fluid. However, the type of fluid is not particularly limited, as long as it is a liquid fluid in which cavitation can occur. For example, the fluid may be water.

The third chamber 7 of the fluid pressure hitting device 1 of the above embodiments are kept in a high fluid pressure state. However, when the first chamber 5 is in a high fluid pressure state, the third chamber 7 may enter a low fluid pressure state. In contrast, when the first chamber 5 is in a low fluid pressure state, the third chamber 7 may enter a high fluid pressure state. In this way, the piston 3 may reciprocate in the axial direction of the cylinder 2.

In the fluid pressure hitting device 1 described above, the inner peripheral surface 2*a* of the cylinder 2 is provided with grooves. As a result, the first chamber 5, the second chamber 6, the third chamber 7, the pilot chamber 8, and/or the fourth chamber 9 are formed between the inner peripheral surface 2*a* of the cylinder 2 and the outer peripheral surface 3*s* of the piston 3. Alternatively, the shape of the inner peripheral surface of the cylinder 2 may be combined with the shape of the outer peripheral surface of the piston 3 to form the first chamber 5, the second chamber 6, the third chamber 7, the pilot chamber 8, and/or the fourth chamber 9.

The fluid pressure hitting device 1 described above has both a first flow path 11 and a second flow path 12. Alternatively, the fluid pressure hitting device 1 may have only one of the first flow path 11, the second flow path 12, or the third flow path 15. The check valve 13 of the above embodiments is provided in the first flow path 11. Alternatively, the check valve 13 may be provided in the second flow path 12 and/or the third flow path 15. Further, the throttle portion 14 of the above embodiments is provided in the second flow path 12. Alternatively, the throttle portion 14 may be provided in the first flow path 11 and/or the third flow path 15.

A fluid supply portion capable of supplying fluid to the first chamber is the second chamber, the third chamber, and/or the fourth chamber in the above embodiments. The fluid supply portion may be any structure capable of supplying fluid so as to relax the low pressure state of the first chamber when the piston hits the chisel. For example, a separate hydraulic tank may be provided to supply fluid to the first chamber, as needed.

EXAMPLES

Figure 6:
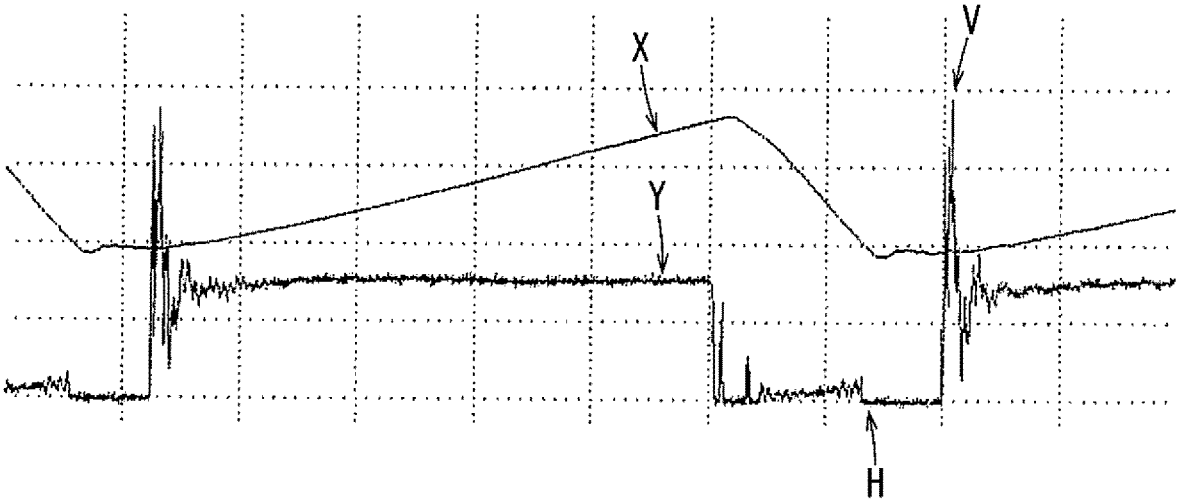
FIG. 6 is a graph showing a waveform of oil pressure in a first chamber of an upper constant high pressure type hydraulic hitting device having only a first flow path.

Hereinafter, embodiments will be further described with reference to first to third examples and a comparative example shown in FIGS. 6 to 9. In the first example, only the first flow path 11 (and the check valve 13) of the fluid pressure hitting device 1 shown in FIG. 1 described above is provided; the second flow path 12 (and the throttle portion 14) is not provided. In the first example, a fluid pressure in the first chamber 5 and a gas pressure in the gas chamber 2*b* were determined. The results of the first example are shown in FIG. 6. In the graph of FIG. 6, X indicates the gas pressure in the gas chamber 2*b*. Y indicates the fluid pressure in the first chamber 5. H indicates a moment when the piston 3 hit the chisel 4. V indicates a moment when the state of the fluid pressure hitting device 1 shifts from that shown in FIG. 5 to that shown in FIG. 2. At this moment, the valve high pressure chamber 33 and the valve reversing chamber 34 become in communication with each other, such that the valve reversing chamber 34 enters a high fluid pressure state. As a result, the first chamber 5, which is in communicate with the valve reversing chamber 34 via the passage 22, also enters a high fluid pressure state.

Figure 7:
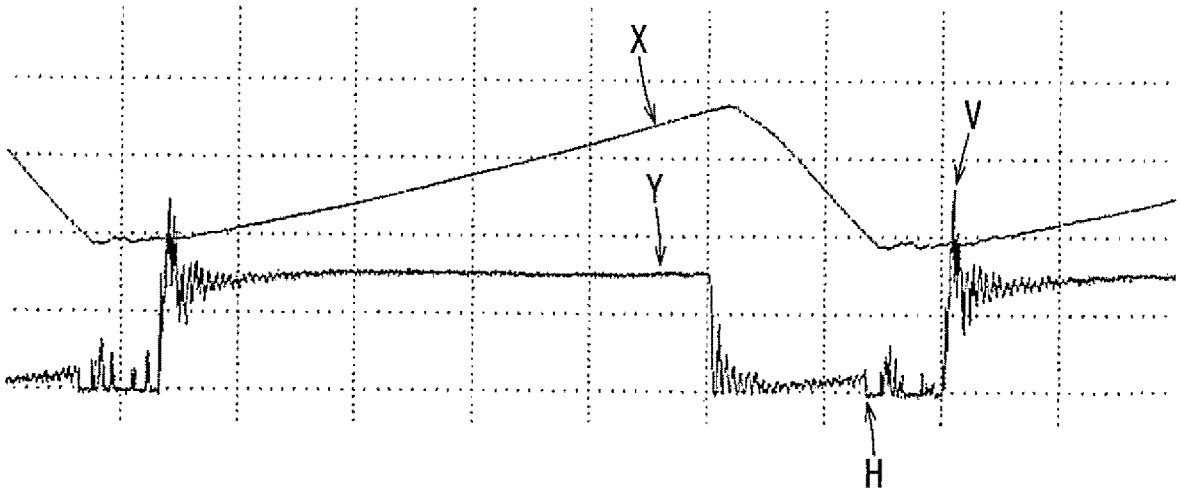
FIG. 7 is a graph showing a waveform of oil pressure in the first chamber of an upper constant high pressure type hydraulic hitting device having only a second flow path.
Figure 8:
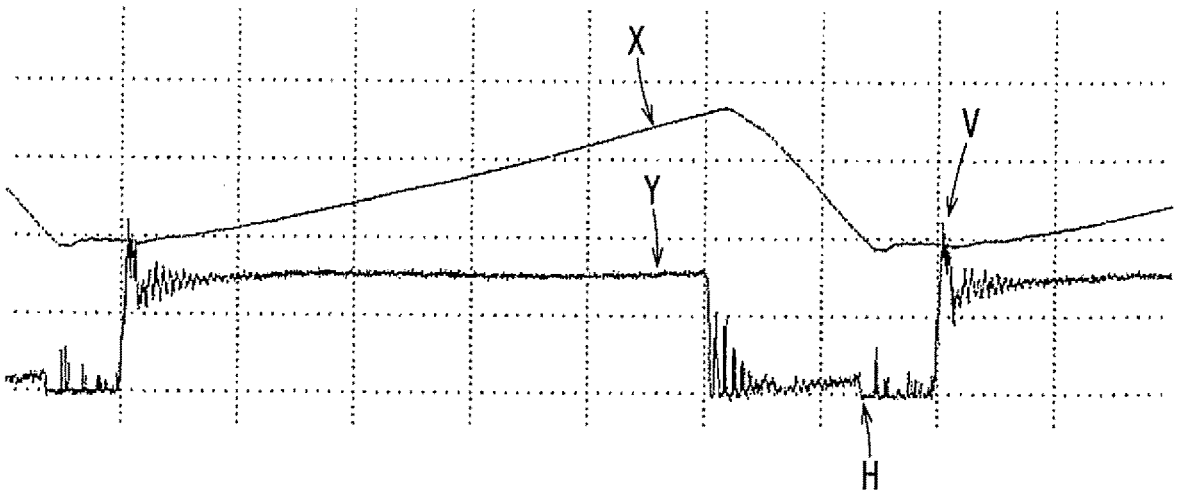
FIG. 8 is a graph showing a waveform of oil pressure in the first chamber of an upper constant high pressure type hydraulic hitting device having both a first and second flow paths.

In the second example, only the second flow path 12 (and the throttle portion 14) of the fluid pressure hitting device 1 shown in FIG. 1 was provided; the first flow path 11 (and the check valve 13) was not provided. In the second example, the fluid pressure in the first chamber 5 and the gas pressure in the gas chamber 2*b* were determined. In the third example, both the first flow path 11 and the second flow path 12 were provided, as was the structure for the above-described fluid pressure hitting device 1. In the third example, the fluid pressure in the first chamber 5 and the gas pressure in the gas chamber 2*b* were determined. The results of Example 2 are shown in FIG. 7. The results of Example 3 are shown in FIG. 8. The testing method for FIGS. 7 and 8 was the same method as that of FIG. 6.

Figure 9:
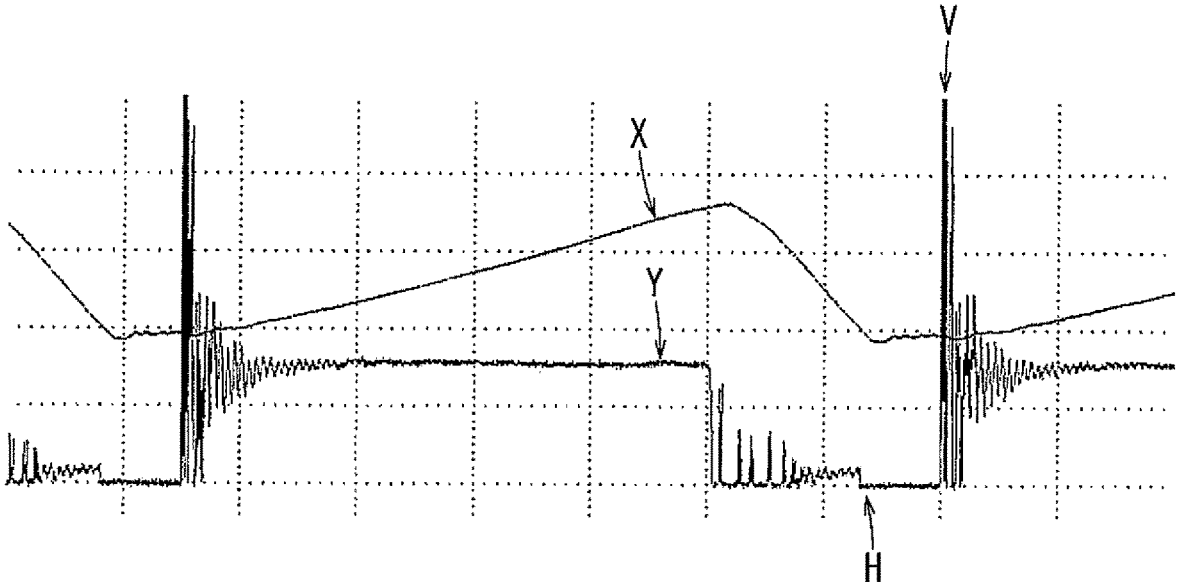
FIG. 9 is a graph showing a waveform of oil pressure in a first chamber of a conventional upper constant high pressure hydraulic hitting device.

In the comparative example, neither the first flow path 11 (and the check valve 13) nor the second flow path 12 (and the throttle portion 14) of the fluid pressure hitting device 1 shown in FIG. 1 were provided. In the comparative example, the fluid pressure in the first chamber 5 and the gas pressure in the gas chamber 2*b* were measured. The results of the comparative example are shown in FIG. 9. The testing method for FIG. 9 was the same method as that of FIG. 6.

In the comparative example (see FIG. 9), when the piston 3 hit the chisel 4 as shown in FIG. 5 (at the moment of H in FIG. 9), the fluid pressure in the first chamber 5 decreased. Then, the fluid pressure in the first chamber 5 significantly rose when the first chamber 5 reached a high fluid pressure state (at the moment of V in FIG. 9). That is, from the moment when the piston 3 hit the chisel 4 to just after the hit, the low-pressure state of the first chamber 5 suddenly changed to the high-pressure state. We believe that the greater the degree of this high pressure state, the greater the degree of crushing the bubbles generated in the oil in the first chamber 5. That is, in the comparative example, since the degree of the high pressure state was great, we believe that the bubbles were rapidly crushed in the first chamber 5. Accordingly, we believe that cavitation, and its associated erosion, could have easily occurred in the first chamber 5 in the comparative example.

In the first example (see FIG. 6), when the piston 3 hit the chisel 4 as shown in FIG. 5 (at the moment of H in FIG. 6), the fluid pressure in the first chamber 5 decreased. However, when the first chamber 5 reached a high pressure state (at the moment of V in FIG. 6), the fluid pressure (or the degree of the high pressure state) in the first chamber 5 was smaller than that of the comparative example (see FIG. 9). Because even if bubbles are generated, a sudden crushing of the bubbles is suppressed, thereby suppressing the high pressure state. That is, a sudden crushing of bubbles in the first example was suppressed as compared with the comparative example. Thus, the occurrence of cavitation, and its associated erosion, in the first example was suppressed. This was due to the first flow path 11 (and the check valve 13) being provided to relax the low pressure state of the first chamber 5 when the piston 3 hits the chisel 4.

In the second example (see FIG. 7), when the piston 3 hits the chisel 4 as shown in FIG. 5 (which corresponds to the moment of H in FIG. 7), the fluid pressure in the first chamber 5 decreases. When the first chamber 5 reached the high pressure state (at the moment of V in FIG. 7), the fluid pressure in the first chamber 5 was smaller than that of the comparative example (see FIG. 9) because even if bubbles are generated, the sudden crushing of the bubbles is suppressed, thereby suppressing the high pressure state. The sudden crushing of bubbles in the second example was suppressed as compared with the comparative example. The occurrence of cavitation, and its associated erosion, was suppressed in the second example. This is because the second flow path 12 (and the throttle portion 14) is provided to relax the low pressure state of the first chamber 5 when the piston 3 hits the chisel 4. Further, the degree of the high pressure state in the second example was smaller than that of the first example because the fluid pressure in the third chamber 7 was higher than the fluid pressure in the second chamber 6, thereby supplying a more sufficient amount of oil to the first chamber 5.

In Example 3 (see FIG. 8), when the piston 3 hits the chisel 4 as shown in FIG. 5 (corresponding to the moment of H in FIG. 8), the fluid pressure in the first chamber 5 decreased. When the first chamber 5 reached the high pressure state (at the moment of V in FIG. 8), the fluid pressure in the first chamber 5 was smaller than that of the comparative example (see FIG. 9) because even if bubbles are generated, a sudden crushing of the bubbles was suppressed, thereby suppressing the high pressure state. The sudden crushing of bubbles was suppressed in the third example as compared with the comparative example. As a result, the occurrence of cavitation, and its associated erosion, was suppressed. This is because the first flow path 11 (and the check valve 13) and the second flow path 12 (and the throttle portion 14) were provided to relax the low pressure state of the first chamber 5 when the piston 3 hits the chisel 4. Further, the degree of the high pressure state in the third example was smaller than that of both the first example and the second example because oil was properly supplied from both the second chamber 6 and the third chamber 7.

The invention claimed is:

1. A fluid pressure hitting device, comprising:

a cylinder having a cylindrical shape;

a piston inserted in the cylinder and configured to slide in an axial direction of the cylinder;

a chisel having a bar shape and fitted in the cylinder such that a part of the chisel projects from one axial end of the cylinder, the chisel being configured to further project from the one axial end due to being hit by the piston as the piston slides toward the one axial end; and a first chamber, a second chamber, and a third chamber partitioned by an inner peripheral surface of the cylinder and an outer peripheral surface of the piston, the first, second, and third chambers being arranged in the axial direction in order from the one axial end of the cylinder to another axial end of the cylinder, wherein:

the piston is configured to slide between the one axial end and the other axial end of the cylinder when a fluid pressure in the first chamber is shifted between a high fluid pressure and a low fluid pressure, a flow path is configured to supply fluid from a fluid supply portion to the first chamber, the fluid supply portion has a fluid pressure higher than a fluid pressure of the first chamber when the piston hits the chisel; and the fluid supply portion includes the second chamber.

2. The fluid pressure hitting device according to claim 1, wherein the fluid supply portion includes the third chamber.

3. The fluid pressure hitting device according to claim 1, wherein:

the flow path is provided with a check valve, and the check valve is configured to allow fluid flow from the fluid supply portion to the first chamber and to prevent fluid flow from the first chamber to the fluid supply portion.

4. The fluid pressure hitting device according to claim 1, wherein at least a part of the flow path is provided with a throttle portion where a fluid passage is narrowed.

5. The fluid pressure hitting device according to claim 1, wherein:

the fluid supply portion includes the second chamber and the third chamber, a first part of the flow path connects the first chamber with the second chamber and is provided with a check valve, the check valve is configured to allow fluid flow from the second chamber to the first chamber and to prevent fluid flow from the first chamber to the second chamber, and at least a part of a second part of the flow path connects the first chamber with the third chamber and is provided with a throttle portion where a fluid passage is narrowed.

6. The fluid pressure hitting device according to claim 1, further comprising a fourth chamber, wherein:

the fourth chamber is positioned between the second chamber and the third chamber in the axial direction of the cylinder, the fourth chamber is partitioned by the inner peripheral surface of the cylinder and the outer peripheral surface of the piston, the fluid supply portion includes the fourth chamber, and the fluid is configured to be supplied from the fourth chamber to the first chamber when the piston hits the chisel.

7. The fluid pressure hitting device according to claim 1, wherein the third chamber is in a high fluid pressure state during a full operation cycle.

8. The fluid pressure hitting device according to claim 1, wherein the flow path is configured to provide fluid communication between the fluid supply portion and the first chamber when the piston hits the chisel.

9. The fluid pressure hitting device according to claim 1, further comprising a switching valve configured to shift the fluid pressure in the first chamber between the high fluid pressure and the low fluid pressure, wherein the flow path between the fluid supply portion and the first chamber does not pass through the switching valve.

10. A fluid pressure hitting device, comprising:

a cylinder;

a piston inserted in the cylinder, the piston being configured to slide in an axial direction of the cylinder;

a chisel fitted in the cylinder such that a part of the chisel projects from a first axial end of the cylinder, the chisel being configured to further project from the first axial end due to being hit by the piston as the piston slides toward the first axial end;

a first chamber, a second chamber, and a third chamber partitioned by an inner peripheral surface of the cylinder and an outer peripheral surface of the piston, the first, second, and third chambers being arranged in the axial direction in order from the first axial end of the cylinder to a second axial end of the cylinder; and a flow path configured to supply fluid to the first chamber, wherein:

the piston is configured to slide between the first axial end and the second axial end of the cylinder when the first chamber is shifted between a high fluid pressure state and a low fluid pressure state, the flow path is configured to supply the fluid to the first chamber when the first chamber is in the low fluid pressure state, the piston is configured to hit the chisel while the first chamber is in the low fluid pressure state , and the fluid in the flow path flows into the first chamber as the piston slides toward the first axial end while the first chamber is in the low fluid pressure state.

11. The fluid pressure hitting device according to claim 10, wherein, when the first chamber is in the low fluid pressure state, an amount of fluid that flows out of the first chamber is greater than an amount of the fluid that flows into the first chamber from the flow path.

12. The fluid pressure hitting device according to claim 10, further comprising:

a switching valve configured to shift the fluid pressure in the first chamber between the high fluid pressure state and the low fluid pressure state; and a passage configured to provide fluid communication between the switching valve and the first chamber when the first chamber is in the low fluid pressure state.

13. The fluid pressure hitting device according to claim 12, wherein fluid within the passage flows from the first chamber to the switching valve while the flow path supplies fluid to the first chamber when the first chamber is in the low fluid pressure state.

14. The fluid pressure hitting device according to claim 10, further comprising a fluid supply portion configured to supply the fluid to the first chamber when the first chamber is in the low fluid pressure states, wherein the fluid in the flow path is configured to travel between the fluid supply portion and the first chamber without passing through the switching valve.

15. The fluid pressure hitting device according to claim 10, wherein the fluid in the flow path is configured to flow from the third chamber to the first chamber while the first chamber is in the low fluid pressure state.

16. The fluid pressure hitting device according to claim 10, wherein:

the flow path includes a check valve between the second chamber and/or the third chamber and the first chamber, the check valve is configured to allow fluid flow from the second and/or third chamber to the first chamber when the first chamber is in the low fluid pressure state, and the check valve is configured to prevent fluid flow from the first chamber to the second and/or third chamber when the first chamber is in the low fluid pressure state.

17. The fluid pressure hitting device according to claim 10, further comprising a fourth chamber positioned between the second chamber and the third chamber, wherein:

the fourth chamber is partitioned by the inner peripheral surface of the cylinder and the outer peripheral surface of the piston, the flow path provides fluid communication between the fourth chamber and the first chamber, and the fluid is configured to be supplied from the fourth chamber to the first chamber when the first chamber is in the lower fluid pressure state.

* * * * *